US005456192A

United States Patent [19]

Trigg et al.

[11] Patent Number: 5,456,192

[45] Date of Patent: Oct. 10, 1995

[54] CROTCH OVERLOCKING AND SEAMING APPARATUS

[75] Inventors: Craig Trigg, Bayswater; Ronald Anderson, Vermont; Heinz Westermeir, South Box Hill; Rob Blake, Horsham, all of Australia

[73] Assignee: Pacific Dunlop Limited, Victoria, Australia

[21] Appl. No.: 108,597

[22] Filed: PCT/Mar. 6, 1992

[86] PCT No.: PCT AU92/00100

§ 371 Date: Dec. 15, 1993

§ 102(e) Date: Dec. 15, 1993

[87] PCT Pub. No.: 92/15212

PCT Pub. Date: Sep. 17, 1992

[30] Foreign Application Priority Data

Mar. 8, 1991 [AU] Australia ..... PK5024

[51] Int. Cl.[6] ..... D05B 19/00

[52] U.S. Cl. ..... 112/470.05; 112/311; 112/470.01; 112/470.36

[58] Field of Search ..... 112/121.11, 121.12, 112/121.29, 262.3, 121.15, 2, 311; 901/13, 14, 15, 16, 17, 18, 31

[56] References Cited

U.S. PATENT DOCUMENTS 4,915,040 4/1990 Sakuma et al. ..... 112/262.3 X 5,003,897 4/1991 Yokoe et al. ..... 112/121.12

5,230,764 7/1993 Moll ..... 112/262.3 X

*Primary Examiner*—Peter Nerbun

*Attorney, Agent, or Firm*—Banner & Allegretti, Ltd.

[57] ABSTRACT

Apparatus is provided for sewing the crotch portion of a pair of aligned blanks of limp fabric and stacking the sewn blanks which comprises robots (10 and 20) located one on each side of an operator. Each of the robots (10 and 20) is capable of gripping and removing a limp fabric blank from an associated stack of blanks and transporting the blanks to an operator. The robots (10 and 20) have arms (26) capable of axial movement and movement in a vertical plane and additionally capable of rotating about their axes through an angle of 180°. At least one of the robots (10, 20) is capable of rotation about a vertical axis, effecting horizontal movement of the arm (26). The apparatus also comprises a sewing head (30) for sewing the crotch portion of the pair of aligned blanks, and a blank support/transfer carriage (41) adjacent the sewing head mounted for horizontal movement in a direction substantially parallel with the direction of sewing. A clamp unit (60) is associated with the blank support/transfer carriage (41). The apparatus also includes an integral gripping and stacking mechanism (52, 57) which is capable of gripping and stacking the sewed blanks supported on the blank/transfer carriage (41) at the extremity of its movement away from the sewing head (30).

8 Claims, 4 Drawing Sheets

CROTCH OVERLOCKING AND SEAMING APPARATUS

FIELD OF THE INVENTION

This invention generally relates to the manufacture of underwear from blanks made of limp fabric. More particularly, the invention relates to a method and apparatus for seaming and overlocking (hereinafter referred to as "sewing") the crotch portions of two blanks of limp fabric.

BACKGROUND

Heretofore, the above operation was performed manually by an operator who simultaneously picked up a blank from each of two stacks of blanks located on each side of I 0 the operator, overlapped the blanks ensuring that each side of the blank faces the right way (the fabric having an "outer" face and an "inner" face with respect to the garment to be produced), fed the overlapping blanks to the sewing machine which sews the crotch portion of the garment, and the finished garment is then collected and reassembled for a further operation on the garment.

There are a number of problems associated with the above manual process.

Each stack of blanks is obtained by cutting a strip of fabric which is in concertina formation such that, resultantly, the side facing the operator alternates. This means that every second blank on the stack on both sides of the operator has to be turned by the operator so that a correct match is obtained for the garment, it being understood that the fabric has an "outer" and "inner" surface with respect to the garment. The necessity to remember to turn each second blank manually after picking up said blank from the two stacks is quite onerous on the operator and too often results in mismatches rendering the garment useless.

There is a further problem with respect to the simultaneous picking up of a limp fabric blank from each of two stacks of such blanks. Invariably, more than one blank is picked up by the operator which results in a slowing down of the process.

Furthermore, the simultaneous picking up of a blank from two stacks one on each side of the operator is ergonomically onerous on the operator and often results in RSI problems.

There is a further problem with the sewn blanks after the sewing step, where a further necessary step must be involved, that being the collection and restacking in a consistent manner of the garments ready for the next operation.

Furthermore, due to the short cycle time for this operation, many pick-ups, turn-overs and stack-asides were necessary, this aggravating the possibility of RSI problems of the operator.

OBJECTIVES OF THE INVENTION

Accordingly, it is an objective of the present invention to provide a method and apparatus for sewing the crotch portion of two blanks of limp fabric which method and apparatus eliminate or substantially reduce the problems mentioned hereinabove.

More particularly, it is an objective of the present invention to provide robotic means for picking up and supplying to an operator two complementary pieces of limp fabric blanks from stacks located on both sides of an operator which enables the operator to simply overlap the complementary blanks and feed them to a sewing machine.

It is a further more specific objective of the invention to provide pick up means to automatically collect and stack the sewn blanks ready for the next operation on these blanks.

It is a further objective of the invention to integrate the various steps by means of time sequenced electronically actuated means.

SUMMARY OF THE INVENTION

Accordingly, the invention provides a method of sewing the crotch portion of two complemental limp fabric blanks comprising gripping a limp fabric blank from a stack of blanks located on each side of an operator, transporting said blanks to a location adjacent each side of said operator and within easy reach thereof while turning alternate blanks through 180° so that the operator always has two complementary blanks with the right orientation of the faces of the blank ready for manual alignment by the operator, clamping said aligned blanks to a movable support, feeding said aligned blanks to a sewing head, sewing said overlapping crotch portion while moving the blanks in a horizontal direction to a location adjacent the sewing head, and gripping and stacking the sewed blanks ready for the next operation.

The invention also provides apparatus for sewing the crotch portion of a pair of aligned blanks of limp fabric and stacking the sewn blanks, comprising robotic means located one on each side of an operator, each of said robotic means capable of gripping and removing a limp fabric blank from an associated stack of blanks and transporting the blanks to an operator, said robotic means having an arm capable of axial movement and movement in a vertical plane and additionally capable of rotating about its axis through an angle of 180°, at least one of said robotic means being also capable of rotation about a vertical axis, effecting horizontal movement of said arm; sewing means for sewing the crotch portion of said pair of aligned blanks; a blank support/transfer carriage adjacent said sewing means mounted for horizontal movement in a direction substantially parallel with the direction of sewing: clamping means for clamping down the blanks on the blank support/transfer carriage; integral gripping and stacking means associated with one side of said blank support/transfer carriage capable of gripping and stacking the sewed blanks supported on said blank support/transfer carriage at the extremity of its movement away from the sewing means.

PREFERRED EMBODIMENTS

Conveniently, each robotic means comprises a blank stack support, an upstanding post extending adjacent to said support and, optionally, capable of angular movement about its axis, a blank gripping arm pivotally mounted on one end of the post for movement in a vertical plane and having gripping means mounted for axial movement along said arm and located at its outer extremity for gripping said blank.

Advantageously, the blank gripping means consists of a pair of wheels and an associated plate, said wheels being rotatable in both directions to provide a pinching grip of the blank on engagement therewith when the wheels rotate in one direction and release of the blank when rotated in the opposite direction.

Conveniently, the integral gripping and stacking means comprises a pair of substantially parallel arms mounted one above the other for angular rotation about a substantially vertical axis, a clamping pin associated with the upper arm and mounted for movement in a substantially vertical direction and capable of firmly clamping the sewed blank to the lower arm.

The apparatus also includes, conveniently, optical sensing means located at various critical locations for actuating various movements and the speed of these movements of the components of the apparatus.

The actuation of movements is carried out by per se well known means such as time sequenced, electronically actuated pneumatic means.

DRAWINGS

The invention will now be described and illustrated with reference to the accompanying drawings wherein.

Figure 1:
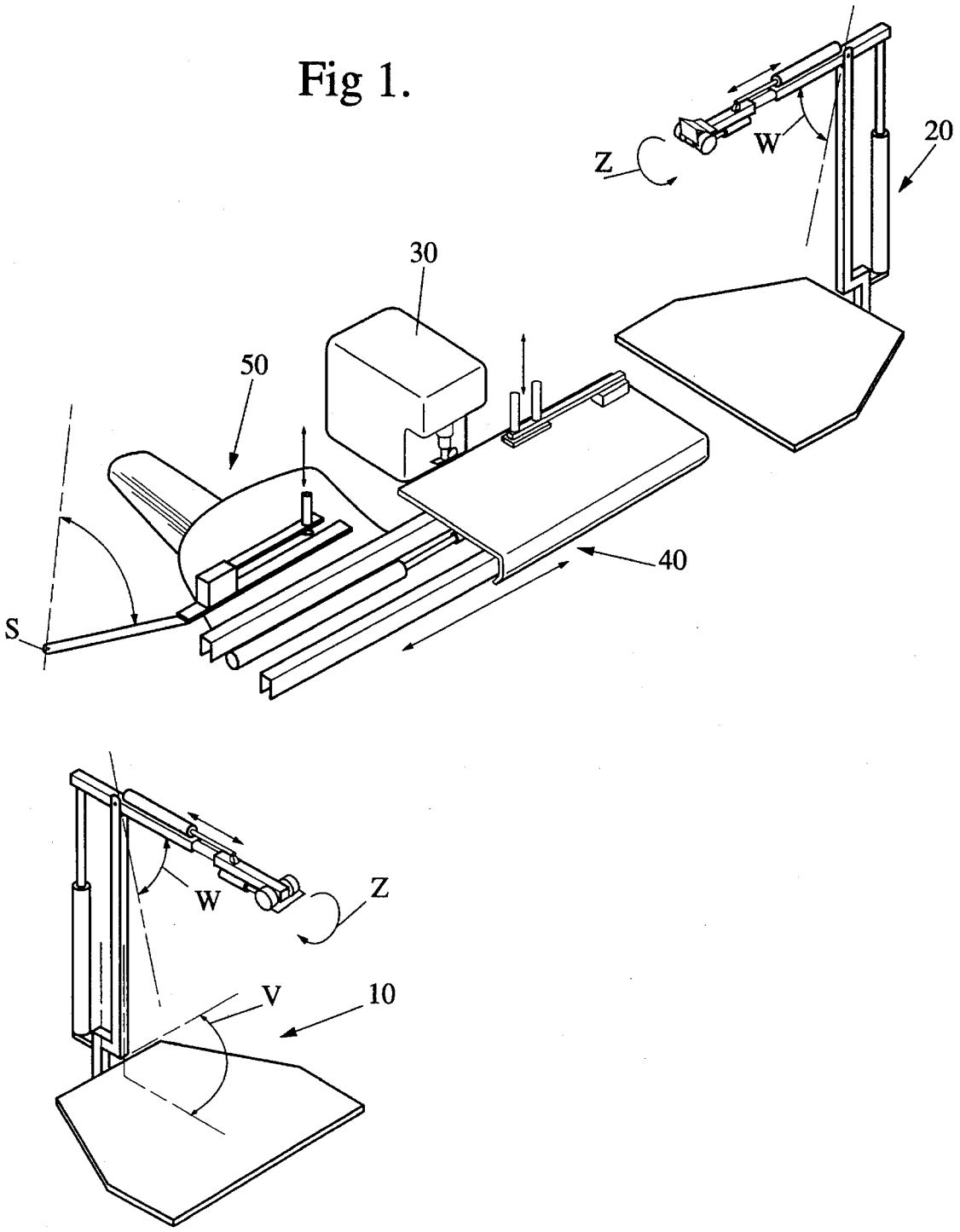
FIG. 1 shows a perspective view of the apparatus according to the invention.

Referring to FIG. 1, two robot units 10 and 20 are arranged on each side of an operator (not shown). As shown in the drawing, robot unit 20 is capable of moving pivotally in a vertical plane whereas robot unit 10 is additionally capable of angular movement about its vertical axis.

Blank support/transfer carriage assembly 40 is mounted for horizontal movement adjacent sewing head 30 and is associated with an integral gripping and stacking unit 50.

Figure 2:
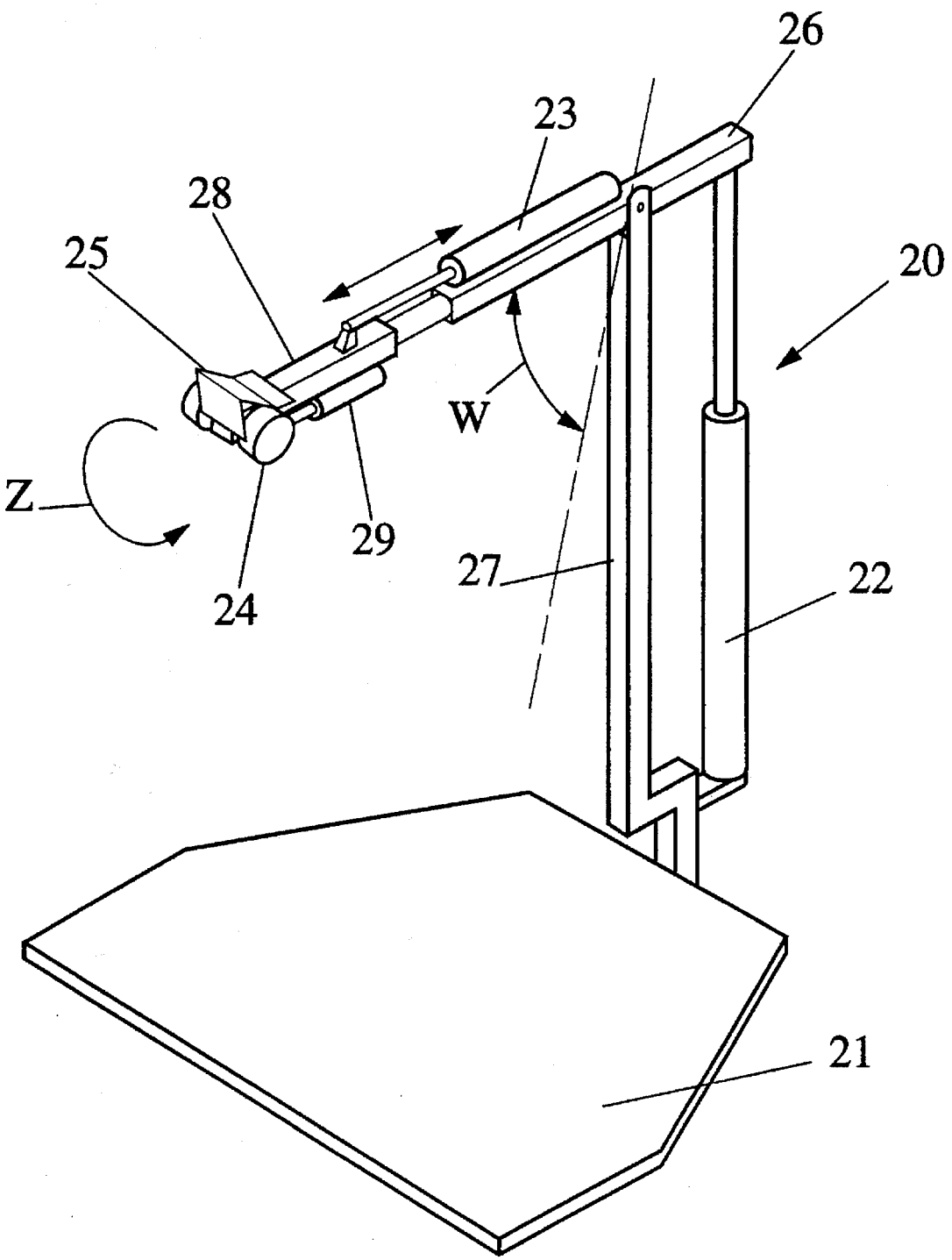
FIG. 2 shows a perspective view of one of the two robotic units of the apparatus shown in FIG. 1.

Referring to FIG. 2, the robot unit 20 comprises a blank supporting plate 21 connected to an upstanding post 27. An arm 26 is pivotally mounted on the outer extremity of post 27 for movement in a vertical plane (cf. arrow "W"). Arm 26 is actuated for pivotal movement by cylinder 22 acting on the outer extremity of arm 26, whereas the inner extremity segment 28) of arm 26 is associated with rollers 24 and cooperating plate 25. Segment 28 can be moved axially by means of piston 23. Furthermore, rollers 24 are actuated for rotation by a small cylinder 29 located on arm 26 adjacent rollers 24. Arm 26 can be rotated through 180° (cf. arrow Z) by a rotary actuator (not shown) located behind cylinder 13 and 23.

Figure 3:
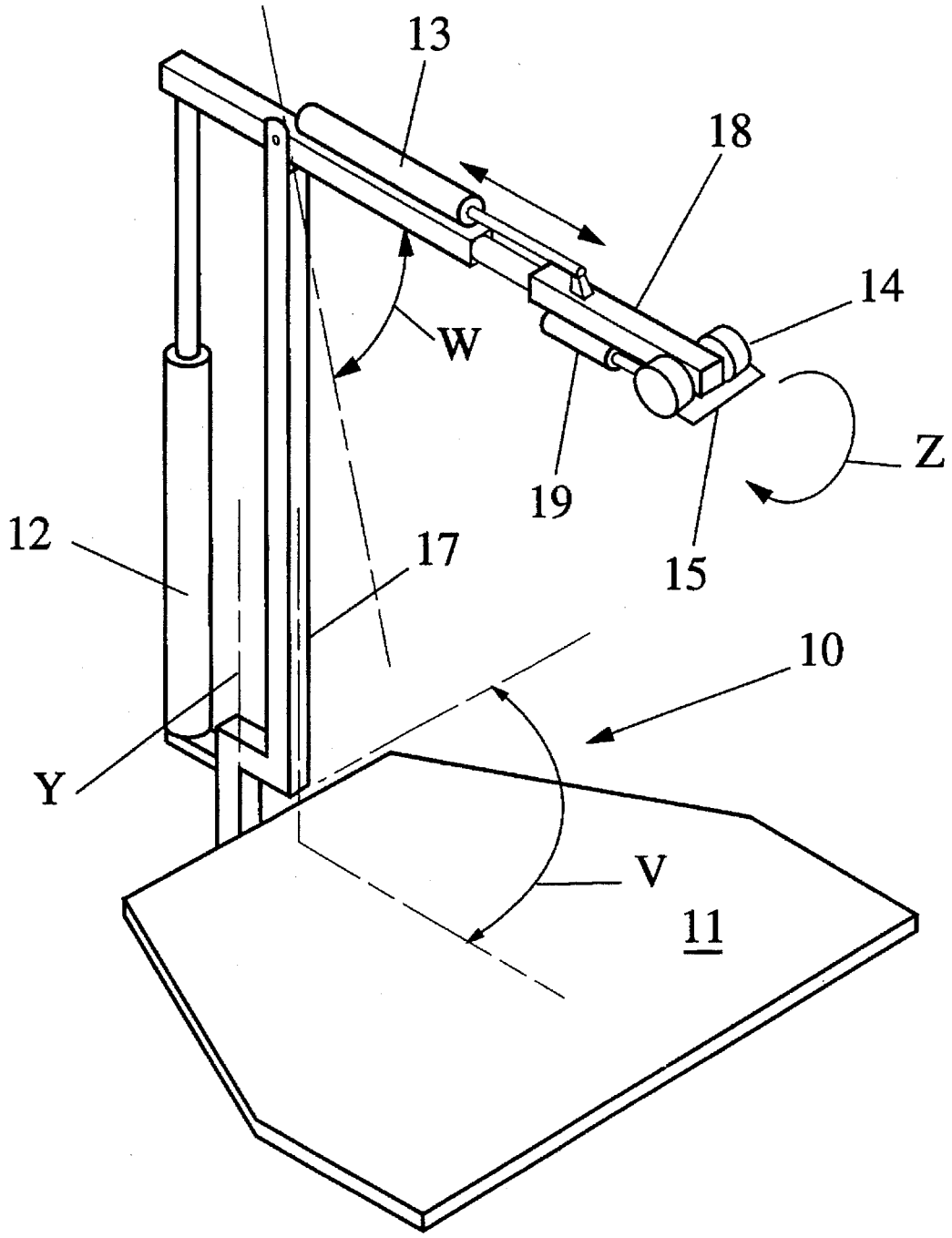
FIG. 3 shows a perspective view of the other robotic unit which is additionally capable of angular movement about a vertical axis.

Referring to FIG. 3, robot unit 10 is identical in construction to robot unit 20 except, in addition, upstanding post 17 is mounted for rotation about its axis and is capable of a 90° pivotal movement as shown by arrow "V". Robot unit 10 is shown with the roller/plate assembly 14, 15 in the 180° alternative configuration.

Figure 4:
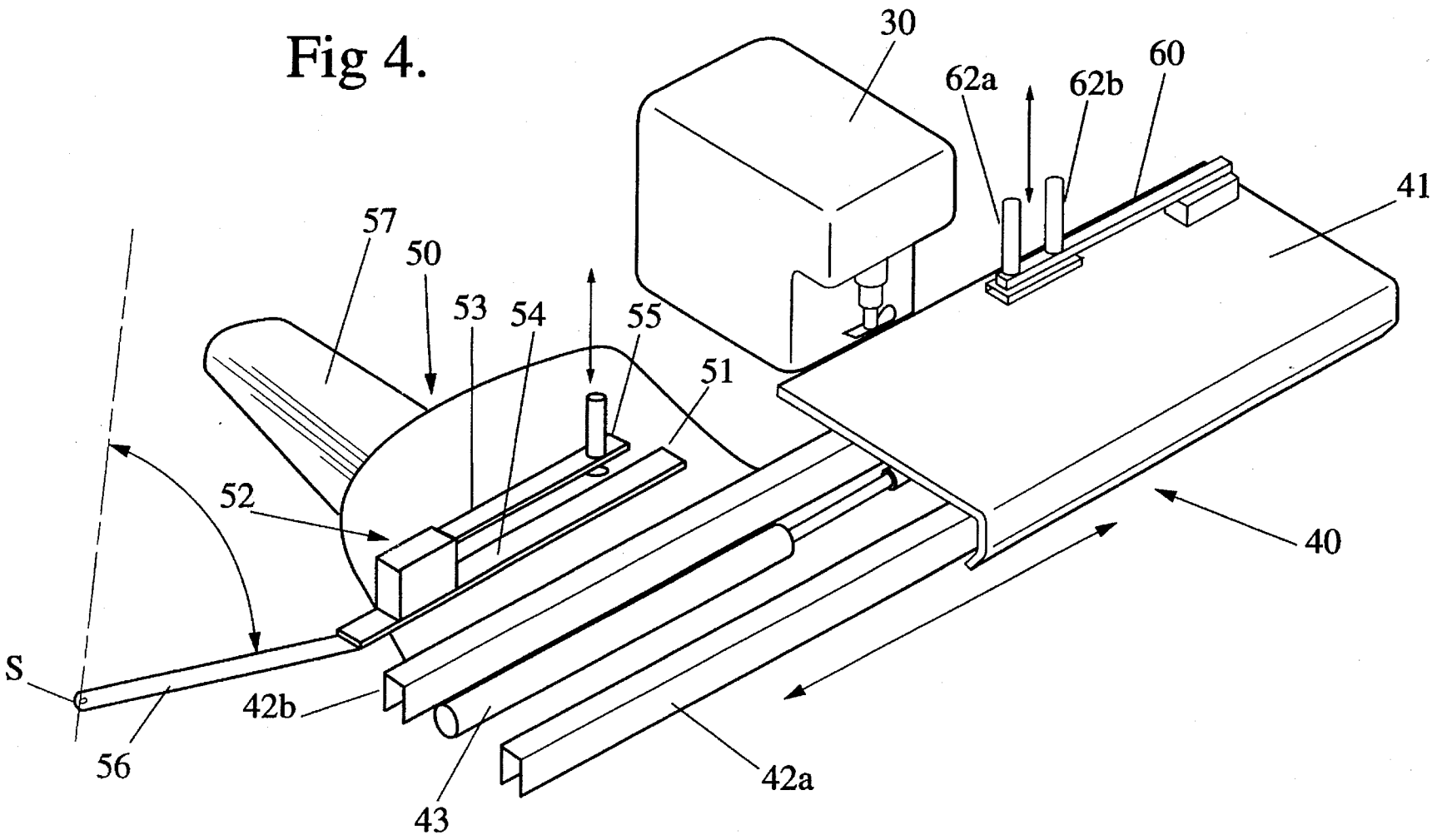
FIG. 4 is a perspective view of the blank support/transfer carriage assembly in association with the sewing head and the integral gripping and stacking unit.

Referring to FIG. 4, a blank support/transfer carriage assembly (generally indicated as 40) comprises a carriage 41 located adjacent a sewing head and mounted for horizontal movement on rails 42*a*, 42*b* actuated by cylinder 43.

A clamp unit 60 is located on carriage 41 and comprises a clamping arm 61 and upstanding pins 62*a*, 62*b* connected thereto and to a cylinder (not shown) which cylinder activates the clamping arm 61 by vertical movement of the pins 62*a*, 62*b*.

The gripper and stacker unit, generally indicated as 50, comprises a guide plate 51 mounted on a table (not shown) underneath rails 42*a*, 42*b*, a clamp unit, generally indicated as 52, and a stacker bed 57.

Clamp unit 52 comprises a link mechanism (not shown) comprising an arm 56 which supports a clamp mechanism comprised of upper and lower arms 53 and 54 and a clamp pin 55 mounted on arm 53 for movement in a vertical direction (as shown).

A stacker bed 57 is also mounted on the table (not shown) for collecting the sewn blanks.

The invention will now be described with reference to the actual mode of use of the above-described apparatus.

Preparation for sewing is carried out by placing a stack of cut blanks (not shown) on blank supporting plates 11 and 21 of the robotic units 10 and 20. The system is initiated for sewing by pressing a valve switch (not shown) attached to the side of blank support plates 11 and 21. This activates cylinder 22 (FIG. 2) tilting the pick-up arm 26 towards the top blank. When cylinder 22 reaches maximum stroke, cylinder 23 extends, pushing the gripper rollers 24 on to the blank. When back pressure is detected within the cylinder 23, another small cylinder 29 is activated which rotates the rollers 24 and wedges the blank against the plate 25. Cylinder 23 then retracts at the same time as cylinder 22, peeling a single blank from the stack. The above description suits both robotic units 10 and 20.

In addition to this, robotic unit 10 (FIG. 3) also pivots on axis Y and cylinder 13 extends again to present the blank closer to the operator. Each alternate time the arms are activated, a rotary actuator (not shown) located behind cylinders 13 and 23 turns the arm assembly (13, 14, 15, 23, 24, 25) 180° to present the right side of the blank to the operator each time.

The operator removes the blank from the group of rollers 14, 24 and matches the edges of the blank to be seamed together.

The aligned blanks are then located on the carriage 41 which houses a sensor (not shown). The blank must be positioned over the sensor and under the clamp unit 60. Upon detection of the blank, the sensor activates the cylinder (not shown) which lowers clamping arm 61 and clamps the blank to be sewn, as well as activating the robotic units 10 and 20 to pick up the next blank. The sewing head 30 is also activated at this stage as well as cylinder 43.

The blank passes through the sewing head 30 and is transferred to the stacker unit 50. When the carriage is detected in this area, clamping pin 55 lowers and clamps the blank.

When the blank has been gripped by clamping pin 55, carriage 41 is returned to its home position and arm 56 pivots on substantially vertical axis S and transfers the sewn blank on to the stacker bed 57. While this has been taking place, the operator has the opportunity to grasp the next piece from each of the robotic units 10, 20 and align them ready for sewing. The cycle then repeats.

The claims defining the invention are as follows:

1. An apparatus for sewing the crotch portion of a pair of aligned blanks of limp fabric and stacking the sewn blanks, comprising:

a pair of robotic units, located one on each side of an operator position, for removing limp fabric blanks from respective stacks of blanks and orienting the same for operator grasping, each of said robotic units comprising:

a gripping device; and an arm mounting said gripping device for translational and rotational movement, whereby said gripping device is positionable to grip a fabric blank in a respective stack of blanks, movable to carry the gripped fabric blank away from the stack of blanks, and rotatable through an angle of 180° to invert the gripped blank;

a sewing device for sewing a crotch portion of said pair of aligned blanks;

a blank support/transfer carriage adjacent said sewing means mounted for movement in a direction substantially parallel with the direction of sewing;

a clamp for clamping down the blanks on the blank support/transfer carriage; and an integral gripping and stacking device located adjacent one side of said blank support/transfer carriage, for gripping and stacking the sewed blanks supported on said blank support/transfer carriage.

2. Apparatus as claimed in claim 1 wherein the arm of at least one of the robotic units is mounted for rotation about a vertical axis to effect horizontal movement of said gripping device.

3. Apparatus as claimed in claim 1 wherein each robotic unit further comprises a blank stack support and an upstanding post extending adjacent to said support, said arm being pivotally mounted on one end of the post for movement in a vertical plane, said gripping device being mounted at an outer extremity of said arm and being axially movable along said arm.

4. Apparatus as claimed in claim 3 wherein the post of at least one of the robotic units is mounted for rotation about a vertical axis to effect horizontal movement of said gripping device.

5. Apparatus as claimed in claim 1 wherein the blank gripping device comprises a pair of wheels and an associated plate, said wheels being rotatable in two directions to provide a pinching grip of the blank on engagement therewith when the wheels rotate in one direction, and to release the blank when rotated in the opposite direction.

6. Apparatus as claimed in any one of claims 1–5 wherein the integral gripping and stacking means comprises a pair of substantially parallel arms mounted one above the other for angular rotation about a substantially vertical axis, a clamping pin associated with the upper arm and mounted for movement in a substantially vertical direction and capable of firmly clamping the sewed blank to the lower arm.

7. Apparatus as claimed in claim 1, wherein the direction of sewing and the parallel movement direction of the blank support/transfer carriage are horizontal.

8. Apparatus according to claim 1, wherein said integral gripping and stacking device is operative to grip and stack the sewed blanks supported on said blank support/transfer carriage when the blank support/transfer carriage reaches an extremity of movement away from the sewing device.

* * * * *